United States Patent [19]

Kuda et al.

[11] Patent Number: 4,552,188

[45] Date of Patent: Nov. 12, 1985

[54] WEFT INSERTING DEVICE

[75] Inventors: Vladimír Kuda, Blažovice; Vladimír Vašíček, Moravsky Krumlov; František Vykydal; Jirí Vystrcil, both of Brno, all of Czechoslovakia

[73] Assignee: ZVS Vyzkumnevyvojovy ustav koncernova ucelova organizace, Brno, Czechoslovakia

[21] Appl. No.: 594,871

[22] Filed: Mar. 29, 1984

[30] Foreign Application Priority Data

Mar. 29, 1983 [CS] Czechoslovakia ..... 2159-83

[51] Int. Cl.[4] ..... D03D 47/30

[52] U.S. Cl. ..... 139/435

[58] Field of Search ..... 139/435, 439; 226/97

[56] References Cited

U.S. PATENT DOCUMENTS 4,326,565 4/1982 Mullekom ..... 139/435

FOREIGN PATENT DOCUMENTS 0090876 10/1983 European Pat. Off. ..... 139/439

1261463 4/1961 France ..... 139/435

183135 8/1966 U.S.S.R. ..... 139/435

*Primary Examiner*—Henry S. Jaudon

[57] ABSTRACT

Weft inserting device adapted to be fixed on the frame of a jet loom or to the beat-up motion thereof. The device has two mixing tubes which are united at the location of their outlet ends so as to form a single central outlet portion terminating in a single outlet opening, the outlet opening being followed by a directing portion with an open passage through. In the weft inserting device of the invention, the central outlet portion of the weft inserting device, starting from the discharge ends of the mixing tubes, is divided by means of a baffle disposed in a first plane which is perpendicular to a second plane containing the longitudinal axes of the mixing tubes, the baffle extending from the discharge point of the mixing tubes throughout at least a portion of the length of the central outlet portion. The longitudinal axis of the baffle lies in a plane which contains the axis of the directing portion of a weft inserting device.

3 Claims, 3 Drawing Figures

WEFT INSERTING DEVICE

This invention relates to a weft inserting device, such device being adapted to be fixed on the frame of a jet loom, or upon the beat-up motion thereof.

There are known devices, which are disclosed in published British patent application No. 2,090,295, having a pair of picking nozzles located in adjacent relationship to the entry portion of a warp shed and disposed one above the other. The outlet ends of the mixing tubes of the picking nozzles of such devices are flattened, whereby a reduced spacing of their axes is obtained. The device is fixedly mounted, and it of a relatively simple construction.

A disadvantage of the above known devices resides in that, upon the insertion of weft thread by means of an air jet into the picking channel the individual weft threads do not lie in one and the same picking axis. Upon entering the picking channel, an uncontrolled turbulent whirling of the air occurs due to unequal inserting trajectories which are not identical with the axis of the picking channel. This can cause an undulatory movement of the weft thread during its insertion, entanglement thereof, and subsequent short picks. A further disadvantage of such known devices resides in the fact that, with the flattened outlet end of the mixing tube, friction of the weft thread takes place on the lower walls of the mixing tube.

Another known weft insertion device described in the coassigned U.S. patent application, Ser. No. 572,950 of Vykydal et al., filed Jan. 23, 1984, for a jet loom is constituted by a bundle of at least two picking nozzles, the mixing tubes of which are united at the point of their outlet ends so as to form a single central outlet portion terminating in a single outlet opening. The outlet opening is followed by a directing portion with a clear passage therethrough, the axis of such passage being parallel to the longitudinal axis of the read of the beat-up motion. This weft inserting device is fixedly mounted on the frame of the loom or upon the beat-up motion thereof. A disadvantage of this prior art weft inserting device resides in the fact that at the discharge point into the central outlet portion the cross-sectonal area is changed and the picking fluid expands in such portion, whereby there are created conditions for inserting the weft thread which are less than ideal.

The above-mentioned disadvantages of the prior art are eliminated by the weft inserting device of the present invention. In the device of the invention, the central outlet portion, starting from the discharge point of the mixing tube, is divided in at least portion of its length by means of a flat baffle disposed in a plane which lies perpendicular to the plane containing the longitudinal axes of said mixing tubes. The device has a forward directing portion with a longitudinally disposed weft directing aperture or passage therethrough, the baffle lying in the axis of the passage aperture in the directing portion of the device.

An advantage of the device according to the present invention is that owing to the division of the central outlet portion thereof by said baffle disposed in the plane containing the axis of the aperture through the directing portion, abrupt transition of the mixing tube cross section into the greatest cross section of the central outlet portion is avoided. There is thereby secured a smoother passage of the picking fluid through the weft inserting device. The weft thread to be inserted leaves the device in a quieter condition, whereby a quiet flight of the weft through the shed of the loom during insertion of the weft is obtained.

The invention will be more readily understood upon consideration of the accompanying drawings, in which.

Figure 1:
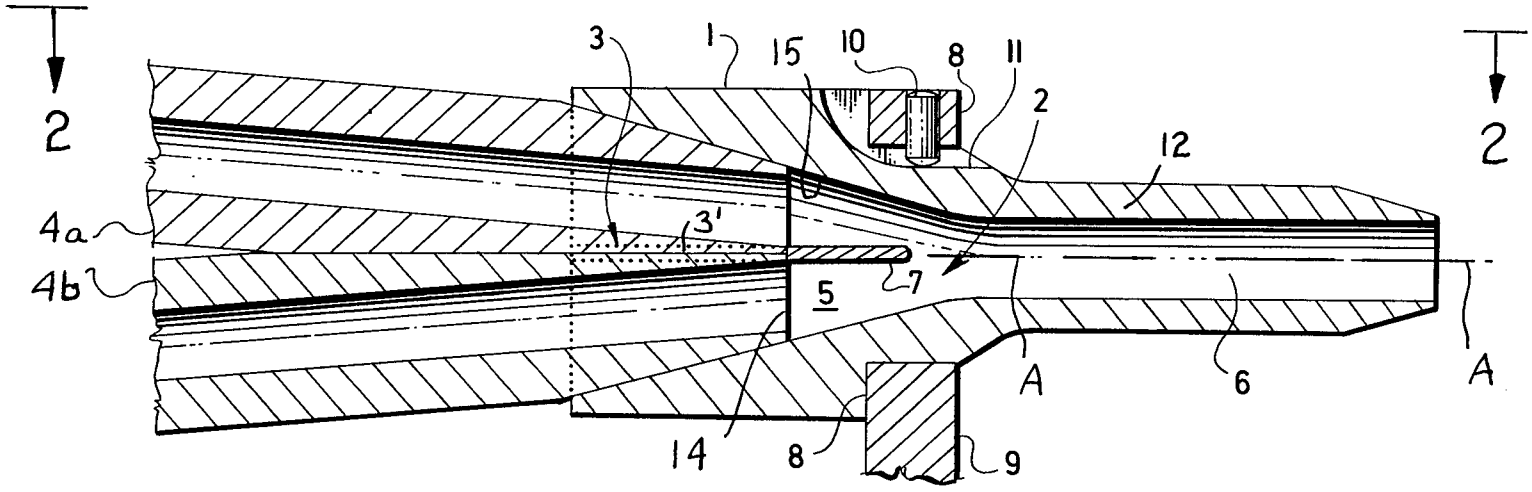
FIG. 1 is a view in vertical longitudinal section through the weft discharge end of a preferred embodiment of weft inserting device in accordance with the invention, the section being taken all along the line 1—1 in FIG. 2.
Figure 2:
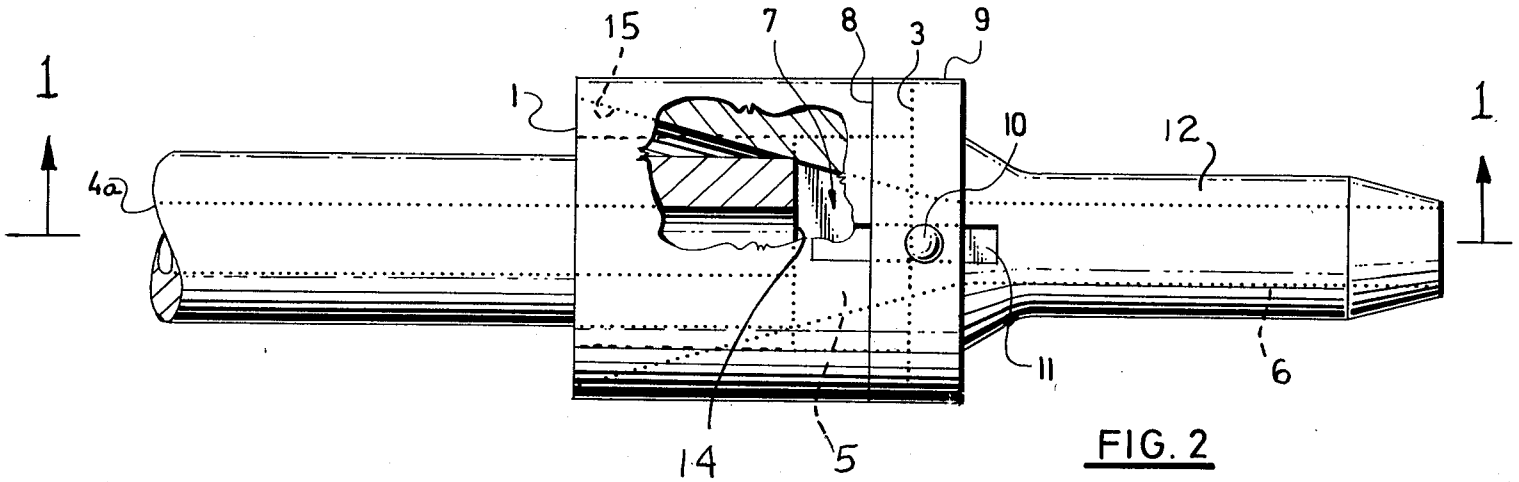
FIG. 2 is a view in vertical plan of the portion of the weft inserting device shown in FIG. 1, the view being taken from the point of view of line 2—2 in FIG. 1.

Turning first to FIGS. 1 and 2, embodiment of weft inserting device shown in the drawings has a body 1 having a longitudinally extending opening therethrough. In its rear or left hand portion body 1 has a central, axially directed forwardly converging, frusto-conical cavity with a side wall 15 therein, the forward, right-hand end of the frusto-conical cavity merging with a axially directed forwardly converging, circular cylindrical weft directing passage 6 disposed centrally within a forward weft directing portion 12 of the body 1. The forward portion of the frusto-conical wall 15 and the passage 6 are together designated generally by the reference character 2. Body 1 is held in a holder 9 having a ring-like upper end received within an annular recess having a rear shoulder 8 in body 1, the body 1 being secured to the holder 9 by means of a pin or set-screw 10 the radially inner end of which it is received within a longitudinally extending groove 11 in body 1. As above explained, holder 9 may be mounted fixedly upon the frame of a jet loom, or may be mounted on the slay of the loom to move therewith, as indicated in FIG. 3.

In the upstream or rear (left hand) portion of the body 1 there are provided grooves 3 disposed in diametrically opposite walls of the frusto-conical recess within the body 1. A pair of upper and lower mixing tubes **4*a*, 4*b*, respectively, have their forward end portions beveled or chamfered, as shown, and received within the rear end of the frusto-conical recess within the body 1. Tubes 4*a* and 4*b* are relatively disposed in such manner that their longitudinal axes converge, as shown in FIG. 1. The engaging sides of the mixing tubes 4*a* and 4*b* are chamfered to form plane surfaces thereon which so abut against each other. Thus the rear, frusto-conical portion of the passage 2 constitutes, starting from the forward or weft thread outlet ends of the mixing tubes 4*a*, 4*b*, a central outlet portion 5. After transition of portion 5 into the aperture 2, aperture 2 merges with the directing portion 6**.

A flat plate baffle 7 is mounted with its upper and lower edges disposed within longitudinal grooves 3 in opposing walls 15 of the frusto-conical cavity in body 1 and with its intermediate portion positioned in oppositely disposed recesses 3 in the chamfered portions of the mixing tubes **4*a* and 4*b*. The forward portion of baffle 7 extends into the central outlet portion 5; baffle 7 extends rearwardly from the discharge mouths of the mixing tubes 4*a*, 4*b* to the rear end of the groove 3. The mixing tubes 4*a*, 4*b*, are positioned in the body 1 in such way that the plane containing the longitudinal axes of the mixing tubes extends in a plane perpendicular to the plane of the flat plane baffle 7**.

Figure 3:
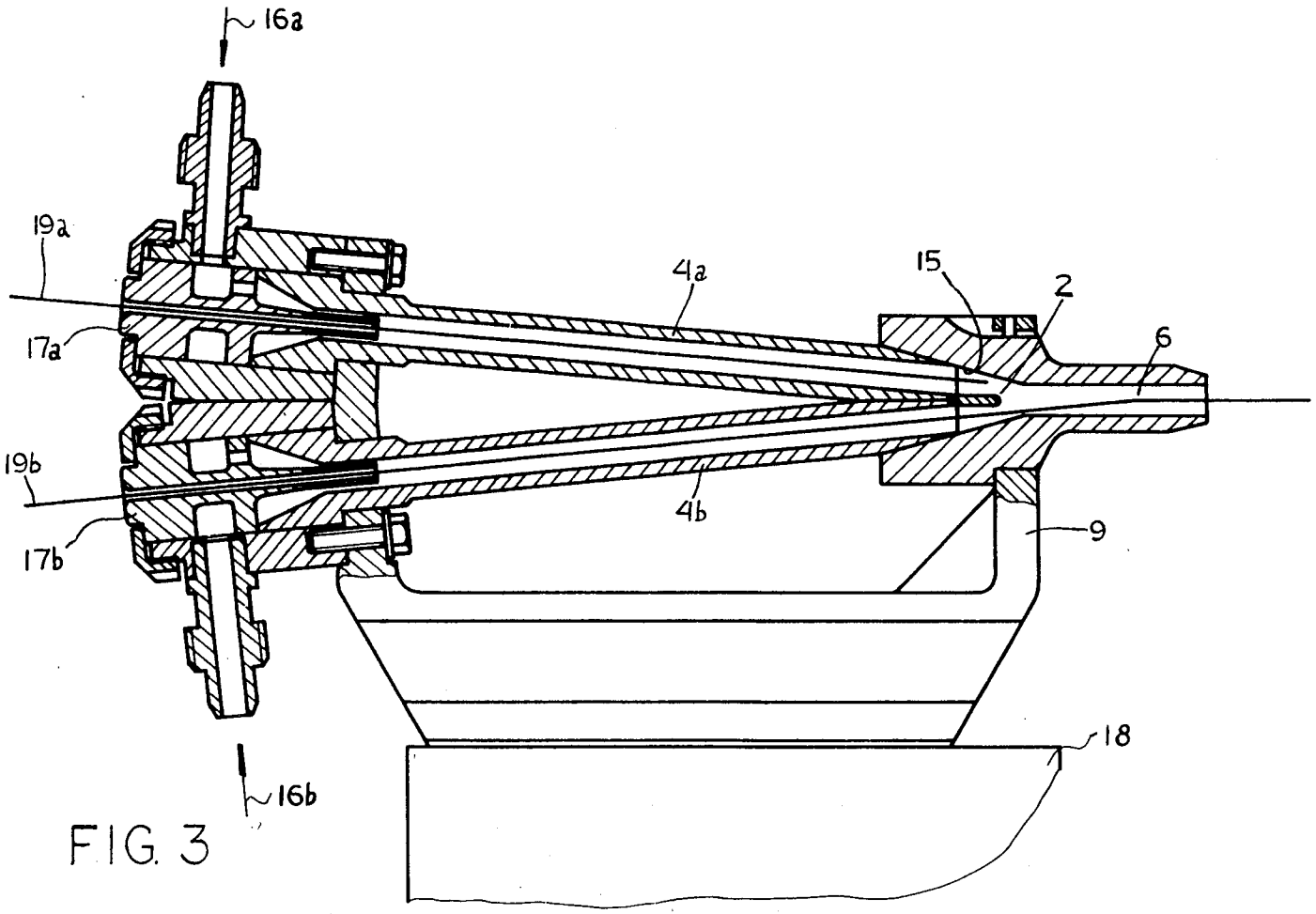
FIG. 3 is a view in vertical longitudinal section through the complete nozzle portion of the illustrative embodiment of weft inserting device partially shown in FIGS. 1 and 2.

FIG. 3 illustrates the complete nozzle portion of the illustrative embodiment of weft inserting device partially shown in FIGS. 1 and 2. At the left, weft-entering ends of the upper and lower mixing tubes 4*a*, 4*b*, respectively, there are connected pressure feeds 16*a* and 16*b*, respectively, which are connected to in let portions 17*a* and 17*b*, respectively, for feeding respective weft threads 19*a*, 19*b*. The nozzle portion shown in FIG. 3 is mounted upon a beat-up motion 18 of a loom.

During weaving, the weft threads 19*a*, 19*b* are alternatively inserted into the shed of a loom, first through one of mixing tubes 4*a*, 4*b* and then through the other mixing tube 4*a*, 4*b*, pressure fluid being alternately admitted into the respective mixing tubes thereby to entrain the weft thread in such tubes. In FIG. 3, weft thread 19*b* is shown being forwarded to be inserted into the loom shed. The free forward end of weft thread 19*b* then being inserted travels through the respective one of the mixing tubes 4*a*, 4*b* into the divided central outlet portion 5 of the device, then into the common directing portion 6 of the passage therethrough, and finally through the warp shed (not shown).

Although the invention is described and illustrated with reference to a single of embodiment thereof, it is to be expressly understood that it is in no way limited to the disclosure of such preferred embodiment but is capable of numerous modifications within the scope of the appended claims.

We claim:

1. In a weft inserting device adapted to be fixed on the frame of a jet loom or the beat-up motion thereof, said device having a pair of picking nozzles provided with pressure fluid feeds and having inlet portons for feeding weft threads into mixing tubes united at a point of their outlet sides for said weft threads into a single central outlet portion having a single outlet opening, said central outlet portion being followed by a directing portion, the improvement wherein said central outlet portion, starting from the discharge point of said mixing tubes, is divided equally at least in a portion of its length by means of a flat baffle lying in a first plane which is perpendicular to a second plane containing the longitudinal axis of said mixing tubes, the longitudinal central axis of said baffle lying in the central axis of said directing portion.

2. A weft inserting device according to claim 1, wherein the mixing tubes are chamfered at their outlet ends and are in engagement with each other along their chamfered surfaces, and the baffle has a portion thereof extending forwardly toward the directing portion of the device from the central zone of the united mixing tubes at the outlet ends thereof.

3. A weft inserting device according to claim 2, wherein said baffle is supported by having a rear portion thereof extending into mating recessed portions of the chamfered outlet ends of the mixing tubes.

* * * * *